US005542828A

United States Patent [19]

Grenci et al.

[11] Patent Number: 5,542,828

[45] Date of Patent: Aug. 6, 1996

[54] LIGHT-GAS-ISOLATION, OIL-FREE, SCROLL VACCUM-PUMP SYSTEM

[76] Inventors: Charles A. Grenci, 205 Brown Rd., Montrose, Colo. 81401; R. Dallas Clayton, 501 Alvarado Dr. NE., Albuquerque, N.M. 87108

[21] Appl. No.: 467,586

[22] Filed: Jun. 6, 1995

Related U.S. Application Data

[62] Division of Ser. No. 341,690, Nov. 17, 1994, abandoned.

[51] Int. Cl.[6] ..... F04C 18/04

[52] U.S. Cl. ..... 418/1; 418/55.2; 417/201

[58] Field of Search ..... 417/201, 199.1, 417/199.2, 205, 901, 53; 418/5, 55.2, 1

[56] References Cited

U.S. PATENT DOCUMENTS

| | | | |
|---|---|---|---|
| 4,613,291 | 9/1986 | Sidransky | 418/55.2 |
| 4,673,399 | 6/1987 | Hayano et al. | 418/55.1 |
| 4,842,499 | 6/1989 | Nishida et al. | 418/55.6 |
| 5,062,771 | 11/1991 | Satou et al. | 417/201 |
| 5,366,358 | 11/1994 | Grenci et al. | 418/55.4 |
| 5,400,604 | 3/1995 | Hafner et al. | 417/901 |

*Primary Examiner*—Timothy S. Thorpe
*Assistant Examiner*—Roland G. McAndrews, Jr.
*Attorney, Agent, or Firm*—Milton S. Gerstein; Marvin N. Benn

[57] ABSTRACT

Close tolerance, oil free scroll type vacuum pumps, when run at RPM speeds in excess of 1800 RPM, prevent pump exhaust outlet to pump vacuum inlet back diffusion (backwards migration) of light atmospheric gases from a process vacuum is useful in a number of vacuum applications. The light gas isolation capability of the invention scroll type vacuum pumps is due to the close tolerance pumping mechanism that these pumps employ, the RPM speed that the mechanism is operated at, and the absence of light gas absorbing materials inside the pump such as oil.

3 Claims, 5 Drawing Sheets

LIGHT-GAS-ISOLATION, OIL-FREE, SCROLL VACCUM-PUMP SYSTEM

This is a divisional of application Ser. No. 08/341,690 filed on Nov. 17,1994, now abandoned.

BACKGROUND OF THE INVENTION

The present invention is directed to the discovery that it is possible to create a first-stage vacuum pump against atmosphere that can isolate atmospheric, light gases, such as helium and hydrogen by preventing the back diffusion (backwards migration) of these gases from the exhaust port of the pump to the inlet port, all as a function of the pump-operation, without the use of additional components such as valves. It is also part of the discovery of the invention that it is possible for the first-stage vacuum pump against atmosphere to provide improved pumping efficiency of light gases, where the percentage of the light gases that enter the pump that is successfully expelled is significantly improved over conventional first- stage vacuum pumps. These discoveries further relate to the specific application of scroll vacuum-pumps, and the configuration-operating parameters that determine the ability of scroll vacuum-pumps to achieve light-gas isolation and efficient light-gas pumping. The present invention relates to the specific application of specifically-configured scroll vacuum-pumps where a minimum background-presence of light gases is required. The present invention is also related to the mechanical configuration and operating parameters that determine the ability of scroll vacuum-pumps to achieve light-gas isolation and efficient light-gas pumping. These mechanical configurations and operating parameters consist of the scroll pumping mechanism tolerances, scroll pumping-mechanism orbiting speed, the vacuum-pressure in the scroll mechanism compression-chambers, the absence of light-gas absorbing materials inside the pump and the number of scroll mechanism compression-chambers between the inlet of the scroll vacuum-pump and its outlet. The optimization of one of these parameters can make an oil-free, scroll-type vacuum-pump outperform conventional, rough vacuum-pumps in respect to light-gas pumping efficiency. Optimization of all of the of the above makes it possible to create a first-stage, scroll vacuum-pump that can provide total, light-gas isolation, and ultra-high performance, light-gas pumping efficiency.

Due to the low atomic mass-weight of light gases, such as helium or hydrogen, it is difficult to efficiently pump these gases with conventional, first-stage vacuum-pumps against atmosphere vacuum, such as oil van or diaphragm rough-vacuum pumps. In addition, both helium and hydrogen are light, fast moving atoms that do not retain the desired directional velocity for efficient pumping, or back-migration isolation, by conventional high-vacuum pumps, such as diffusion, molecular-drag or turbomolecular pumps. This has long created problems for the many vacuum systems that need a low background of light gases, such as high sensitivity helium leak detectors and residual-gas analysis systems, or critical vacuum-processes where light gases are a contaminant. In light-gas measurement systems, back-diffusion of atmospheric light gases through all vacuum pumping stages can create unstable sensor-readings for the quantity of light gas in the vacuum-chamber that is under test. These systems will benefit greatly from the present invention's first-stage roughing pump against atmosphere that can prevent atmospheric, light-gas, back diffusion (backwards migration) from the exhaust port of the pump to the inlet port. These vacuum-systems will also benefit from the present invention, in that it provides high pumping efficiency and high-speed pumping throughput of light gases from the pump-inlet to the pump-exhaust, without the use of light-gas absorbing materials in the pump that will later release the absorbed light gases in bursts that back diffuse to the pump-inlet, which is a fundamental problem associated with prior-art rough-vacuum pumps.

The present invention is directed to the use of a conventional, oil-free scroll-pump as a first-stage roughing pump, in order to isolate the back-flow of gases in a vacuum system. The present invention is directed to the discovery that a scroll-pump has the Capability of completely preventing the back-flow of light gases from the exhaust of the scroll-pump to its inlet, which has especial significance in vacuum systems where it is highly desirable to reduce, or entirely eliminate, such back-flow or back-diffusion.

Vacuums have long been used as an environmental control for experiments and processes. Many times a user wants to remove air, or other gases, from a volume to the lowest level possible, and then fill that volume with a high-purity gas, or gas mixture, for an experiment or manufacturing process. These volumes are called process chambers. Three issues are important: Cleanliness of the containment-vessel, atmospheric leaks into the vessel, and the gases that have not been removed from the process chamber. Hydrogen, which is a highly-reactive gas, is sometimes a major issue in both the manufacturing and the containment of high-purity gases.

Due to the low, atomic mass-weight of light gases, such as hydrogen and helium (atomic mass units 2 and 4, respectively), it is very difficult to evacuate these light gases with conventional vacuum-pumps. The problem is that hydrogen and helium are very light, fast-moving atoms, that do not easily retain the desired directional velocity for effective pumping 23 by conventional, vacuum, diffusion-pumps, turbo-molecular pumps, molecular drag-pumps, etc. These pumps use, as their first stage, a mechanical pump operating in the pressure range of $1\times10^{-2}$ to $2\times10^{-1}$ torr, and, in some cases, pressure as great as 30 torr. The first-stage mechanical pump, commonly referred to as foreline or backing pump, is used with a second stage, high-vacuum pump, such as diffusion, turbomolecular, molecular-drag pumps, etc., which are, typically, oil-vane pumps or multi-stage diaphragm pumps. With the latter, the light gases, hydrogen and helium, are absorbed and released by the diaphragm, which is, typically, an elastomeric material, which allows these light, very active atoms to back-flow or backstream, and, thus, to return to the high-vacuum pump, and, then, backstream through the high-vacuum pump, and, thereby, return to the volume or process chamber that is being evacuated. The higher the concentration of light gases in the high-compression stage of a high-vacuum pump, and in the lines connected to the first-stage foreline-pump and the fore-pump itself, the more the light gases will back-stream through the high-vacuum pump, to return to the vessel that is being evacuated. This back-flow problem is, further, compounded by the fact that diaphragm or membrane pumps have a very low, gas-compression factor.

In the case of an oil-vane pump as the first-stage pump (the type most commonly used), the back-flow of light gases is, further, compounded by the fact that oil is used in the oil-case of the vane-pump. An oil-vane pump uses a stator, which is a stationary volume, in which gases are compressed by a rotor, which is internal to, and revolves in, the stator of the pump. The rotor has slots that are machined through its centerline, in which springs create opposing forces to the vanes and make the vanes contact the walls of the stator. The inlet of the vane-pump allows a volume of gas in the stator to equalize in pressure with the volume being evacuated. As the rotor and vanes rotate, the inlet is isolated, and the trapped volume is compressed and forced through an exhaust valve, thus creating a reduction in gas molecules, and pressure, in the volume being evacuated. The rotor, stator and exhaust valve are all submerged in oil, and mounted in an oil-case. The function of the oil is to lubricate and seal the internal surfaces that are making contact within the stator, namely the rotor, vanes, and exhaust-valve. The oil, thus, lubricates and helps to conduct the heat away from the pumping mechanism, and, also, seals the rotor to the stator, and seals the sliding vanes to both the stator and the end-plates, as well as to the rotor, giving a better seal, and, thus, better compression. The oil also covers the exhaust valve, and aids in the sealing of the exhaust valve. The problem with these oil-vane pumps, however, is that compressed gases form bubbles in the oil, or fluid, and are entrained in the oil, and are, thus, re-injected back into the pumping chamber for lubrication and sealing. These bubbles burst in the pump chamber, thus allowing the light, previously-pumped gases to be reintroduced into the oil- vane pump, to, thus, backstream into the high-compression area of the high-vacuum pump, which causes a higher concentration of the gases in the high-vacuum pump from which these gases may have come in the first place. The greater back-streaming through the high-vacuum pump may allow even higher numbers of these light atoms to return to the volume that is being evacuated, as these light gases will enter the exhaust of the vane- pump from the ambient.

The motion of all atoms and molecules is based on the statistical thermodynamics, and, specifically, motion is determined by the mean-free path of an atom or molecule. The mean- free path is the distance that an atom or molecule can travel before colliding with another atom or molecule, or with the walls that contain them. These collisions impede its travel in back-streaming, or in its pathway to being exhausted to atmosphere by the pump. In viscous flow, there is a pressure differential, with the more negative, or vacuum, pressure being at the pump inlet, whereby, a large number of gas molecules and atoms are entrained, or constrained by the walls and other atoms or molecules. Turbulent flow shortens the mean-free path of an atom or molecule traveling away from the pump that is trying to capture and exhaust them to atmosphere, thus improving the vacuum-pressure. There is a transition phase of gas flow as the pressure differential, or delta P, becomes less and less at the vacuum pump, as gas molecules and atoms are removed. As the gases continue to be removed, the pressure differential virtually becomes zero, and the mean-free path becomes longer and longer, as gas continues to be expelled by the pump. This final phase of gas flow is known as molecular flow, with no pressure differential, and a longer mean-free path before the gas molecules run into each other. Gas-flow becomes random collisions, where the likelihood that a molecule will move toward the pump, be captured, and be exhausted to ambient, with the concomitant lowering of vacuum pressure, is considerably reduced. It is at this phase where light, active gases, such as hydrogen and helium, become a significant problem.

One area where back-flow has been a considerable problem has been in helium-leak detection systems. In these systems, the more helium that can removed from the analyzer or mass-spectrometer cell, the greater sensitivity and the lower the helium-background, which means more net sensitivity. Background is defined as ionized atoms and molecules that strike the collector that are not helium. Sensitivity equals the percentage of only mass 4 ions that strike the collector. Thus, true helium-sensitivity equals sensitivity minus the background signal.

Another area where back-flow is a problem is in a residual gas analyzer, which is a device used in vacuum technology to ascertain the gas species and their concentrations in a vacuum chamber, by measuring their atomic mass unit (AMU). The signal from the sensor indicates the partial-vacuum pressure of a particular AMU or specific gas specie. Although a residual gas analyzer can read AMU's from 1–400, the more commonly used are 1–100 AMU. The main interest to a vacuum technologist are 1–50 AMU. Hydrogen is mass 2 or 2 AMU, helium 4, water vapor comprises 16, 17 and 18, nitrogen 28, oxygen 32, etc.

The residual gases in a vacuum-chamber that are difficult to remove are hydrogen, helium and water vapor. While water vapor is easy to pump or capture, the binding energy to a surface in vacuum is very great. Water molecules cannot be pumped, or captured, until it leaves the surface and gets to the trap or pump. Thus, water vapor is a major problem in attaining a low vacuum-pressure in a reasonable time-frame. Light, active gases, although they arrive at the pump in a much shorter time-frame, are very difficult to compress and eject out to atmosphere. As stated previously, they back-stream through commonly-used pumps, and return to the chamber, whence they have to be pumped away over and over again, until they are finally expelled by the mechanical pump to atmosphere. To add to the problem, high-vacuum components and chambers are typically stainless steel, which continually produce hydrogen. Also, most materials are permeable to hydrogen and helium. Sealing materials are typically elastomers, as is the diaphragm of a diaphragm-pump. These materials have high permeation-rates for light gases into vacuum, giving an even greater light-gas load that must be pumped.

SUMMARY OF THE INVENTION

It is, therefore, the primary objective of the present invention to provide an oil-free scroll-pump as the first-stage pump in vacuum-systems, such as helium-leak detection systems, process-chambers, and the like. The ability of an oil-free scroll-pump to effectively pump light, active gases and its ability to prevent back-flow or back-streaming provides major improvements over conventional systems using a conventional-used first-stage, roughing pump. The back-streaming of light gases into an evacuated vessel or chamber is a major form of contamination in vacuum systems. The unique characteristic of the oil-free scroll-pump shortens the mean-free path of the compressed gas, and, therefore, reduces or eliminates back-streaming.

It is, therefore, the objective of the invention to provide a system for use in high and ultra-high vacuum systems that prevents the back-flow, or back-streaming, of light gases, such as hydrogen and helium, and isotopes thereof, which is achieved by means of the discovery of the present invention that an oil-free scroll-pump, for all intents and purposes, prevents all back-flow of light gases from its exhaust, or outlet, to its intake, or inlet.

According to the invention, in any system where back-flow, or back-streaming, of light gases is a real or potential problem, a scroll-pump is used. The mean-free path of the compressed gas in a scroll-pump is reduced by the multi-stage compression-cycle thereof. By using a plurality of small compressions, or "pockets", isolated from one another throughout the compression cycle, the gas is less likely to "backstream" out the pump-inlet.

The present invention has especial relevance to helium leak-detection systems, where the use of a scroll-pump in the system has the following major benefits: Less background, which gives greater sensitivity, and greater time-savings. Greater time savings ensues because, when a leak is found, the vacuum chamber, the leak detector's vacuum system, and the analyzer cell become saturated with helium. One cannot continue the leak-check until the helium has been pumped out and exhausted to the atmosphere, Which allows the removal of helium from the analyzer cell. The fast recovery by using a scroll pump, which inherently prevents back-flow, and, therefore, lowers the required amount of helium to be pumped out until the next leak-check can be performed, is even more important when one tries to pin-point an indicated leak in a weld, or a microscopic crack in glass, ceramic, or metal, for example. Besides the greater helium-pumping achieved by an oil-free the scroll-pump according to the present invention, the oil-free scroll-pump has no "oil memory" or saturation effect.

The light-gas isolating, scroll-vacuum pump system of the present invention provides effective, light-atmospheric gas isolation and removal from a process vacuum-chamber, or when used in conjunction with a second-stage, high-vacuum pump, and provides improved control over the rate at which these gases are pumped from the sensor in a helium leak detector or residual gas analysis system by the second-stage, high-vacuum pump through to the first-stage vacuum-pump against atmosphere. The background-reduction of these gases increases the available base sensitivity of a helium or residual gas sensor. This light-gas removal pumping-efficiency also provides the benefit of reducing the time required to clear the light gas from a vacuum process-chamber or sensor after the introduction of a light gas. The ability to reduce the light-gas background, increases the base sensitivity, and reduce the time to clear the sensor, which will improve the efficiency and capabilities of any helium, leak-detection system or residual-gas analysis system, or process vacuum-chamber systems, where a high background presence of light gases is a problem.

According to the present invention, it has been found that a conventional, oil-free scroll-pump effectively pumps light, active gases, which is a major advantage in all systems described above, where such light gases can cause serious problems. Another example where light gases are a problem is in the production of high purity, compressed gases. The semiconductor industry is a major user of high-purity gases. According to the discovery of the present invention, a unique characteristic of the oil-free scroll-pump is a long, continuous, five, six or seven stage compression-cycle. Gas enters the inlet of the scroll pump, and it is compressed towards the pump outlet, as described above.

BRIEF DESCRIPTION OF THE DRAWING

The accompanying drawings, which are incorporated into and form a part of the specification, illustrate the preferred embodiment of the invention and, subsequently, are not to be construed as limiting the invention.

DESCRIPTION OF THE PREFERRED EMBODIMENTS

Figure 1:
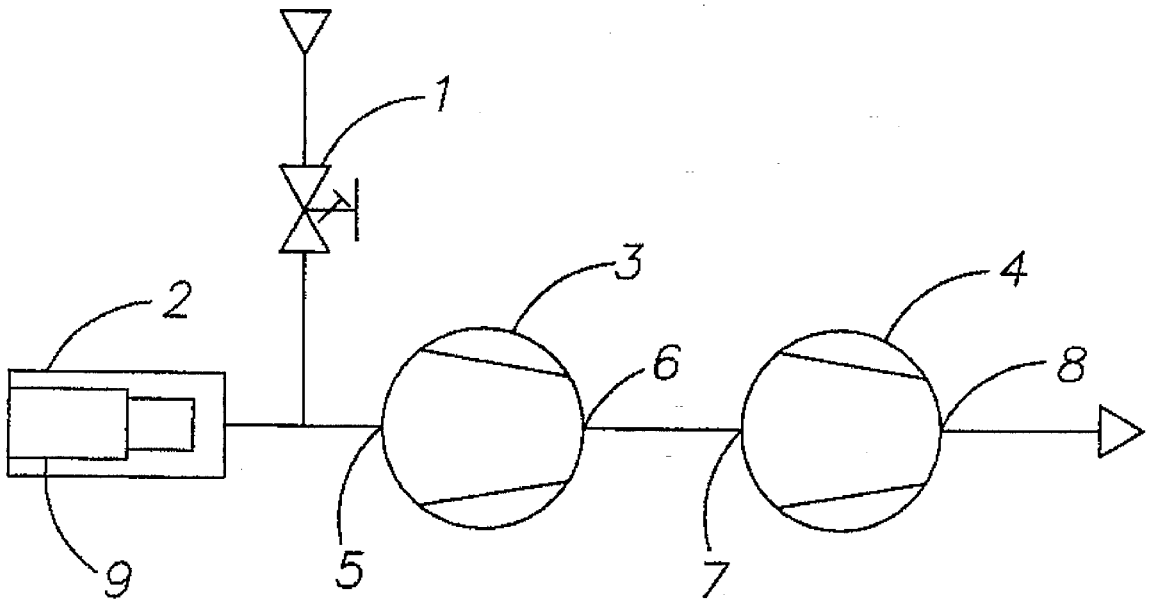
FIG. 1 is a schematic of a typical, high-vacuum pumping configuration with a high-vacuum inlet valve, a high-vacuum chamber, a second-stage, high-vacuum pump, a first-stage rough vacuum-pump against atmosphere, and a mass-spectrometer sensor.

Referring to FIG. 1, a typical, prior-art, high-vacuum pumping system configuration is shown, in order to illustrate several basic components that are used in the construction of such prior-art systems, and in order to better understand the present invention. The components shown in FIG. 1 consist of a high-vacuum inlet valve 1 that is used to introduce a calibrated quantity of gas for the purpose of calibrating the mass-spectrometer sensor 9, or a regulated quantity of process-gas used to react in a specific manner, with the production parts placed inside the high-vacuum chamber 2. The components shown further consist of a high-vacuum pump 3 connected to the high-vacuum chamber 2 at the high-vacuum pump inlet 5. The high-vacuum pump 3 evacuates the high-vacuum chamber 2 to a high-vacuum pressure that allows the mass- spectrometer sensor 9 to function, or evacuates it to a high- vacuum pressure that is required for the specific processing of parts that have been placed inside 16 the high-vacuum chamber 2. Typical high-vacuum pumps that are used to perform chamber- evacuation are: Turbo-molecular pumps, molecular-drag pumps, a combination of turbomolecular/molecular drag, and heated-oil diffusion pumps. These high-vacuum pumps are through-put-type pumps that require a rough-vacuum pump 4 to create a continuous rough-vacuum pressure, where the high-vacuum pump exhaust 6 connects to the rough-vacuum pump inlet 7. This connection between the high-vacuum pump 3 and the rough-vacuum pump 4 is Called the foreline connection. The purpose of this connection is to further process, remove, or expel the gases that are pumped from the high-vacuum chamber 2 by the high-vacuum pump 3. These gases are expelled through the rough-vacuum pump exhaust 8. The rough-vacuum pump 4 is, also, required to create a foreline vacuum-pressure that allows the high-vacuum pump 3 to operate at peak efficiency. The other type of high-vacuum pump that is commonly used in high-vacuum systems is a cryogenic capture pump. When a cryogenic capture pump is used, the rough-vacuum pump 4 does not continuously pump the cryogenic capture pump, or "cryo pump" foreline connection, but rather creates the initial, rough-vacuum pressure that is required to start the cryogenic pump, at which point the rough-vacuum pump 4 is isolated from the cryogenic pump by an additional valve. Typical rough-vacuum pumps that are used to perform roughing are: Oil vane pumps; combination of oil-vane stage/roots stage pumps; oil-lubricated, multiple stage roots; oil-lubricated scroll pumps; dry, multiple-stage roots/claw; dry combination roots/claw; oil-free diaphragm pumps; and oil- free screw-type pumps.

Some high-vacuum systems further require a low background presence of light gases, such as helium or hydrogen, or efficient pumping of these light gases that may be generated by the process-operation of the high-vacuum system. These systems have long experienced problems that relate to the ability of the prior-art high and rough vacuum-pumps mentioned to isolate (prevent the back migration) of light gases, and the ability of these pumps to efficiently pump the light gases. This deficiency arises due to the low, atomic mass-weight and small size of light gas atoms such as helium or hydrogen. It is difficult to efficiently pump these light gases with conventional, first-stage-against-atmosphere, rough vacuum-pumps, such as oil-vane pumps, or diaphragm rough-vacuum pumps. In addition, both helium and hydrogen are small, light, fast moving atoms that do not retain the desired directional velocity for efficient pumping by conventional vacuum-pumps. The inability of the conventional, high-vacuum pumps to effectively pump light gases is due to excessive back-diffusion, or backwards-migration, of light gases from the pump-outlet to the pump-inlet. If the first-stage, rough-vacuum pump cannot effectively pump light gas, some of the light gases that are successfully pumped by the second stage high-vacuum pump can back-diffuse into the chamber that the second-stage, high-vacuum pump is evacuating. This creates problems in vacuum-systems, such as high-sensitivity helium leak-detectors, residual gas analysis systems, or critical vacuum-processes where light gases are a contaminant. In these measurement systems, back-diffusion of atmospheric light gases through all vacuum-pumping stages can create unstable sensor- readings for the quantity of light gas in the vacuum-chamber that is under test. These sensitive systems greatly benefit from the system of the present invention, where an oil-free scroll pump against atmosphere is used as the first-stage pump, which prevents atmospheric light gas, back diffusion (backwards migration) from the exhaust port of the pump to the inlet port thereof, and provides improved pumping speed for light gases without the use of light gases in bursts that back diffuse to the pump-inlet, which is a fundamental problem associated with prior-art, rough-vacuum pumps.

Figure 2:
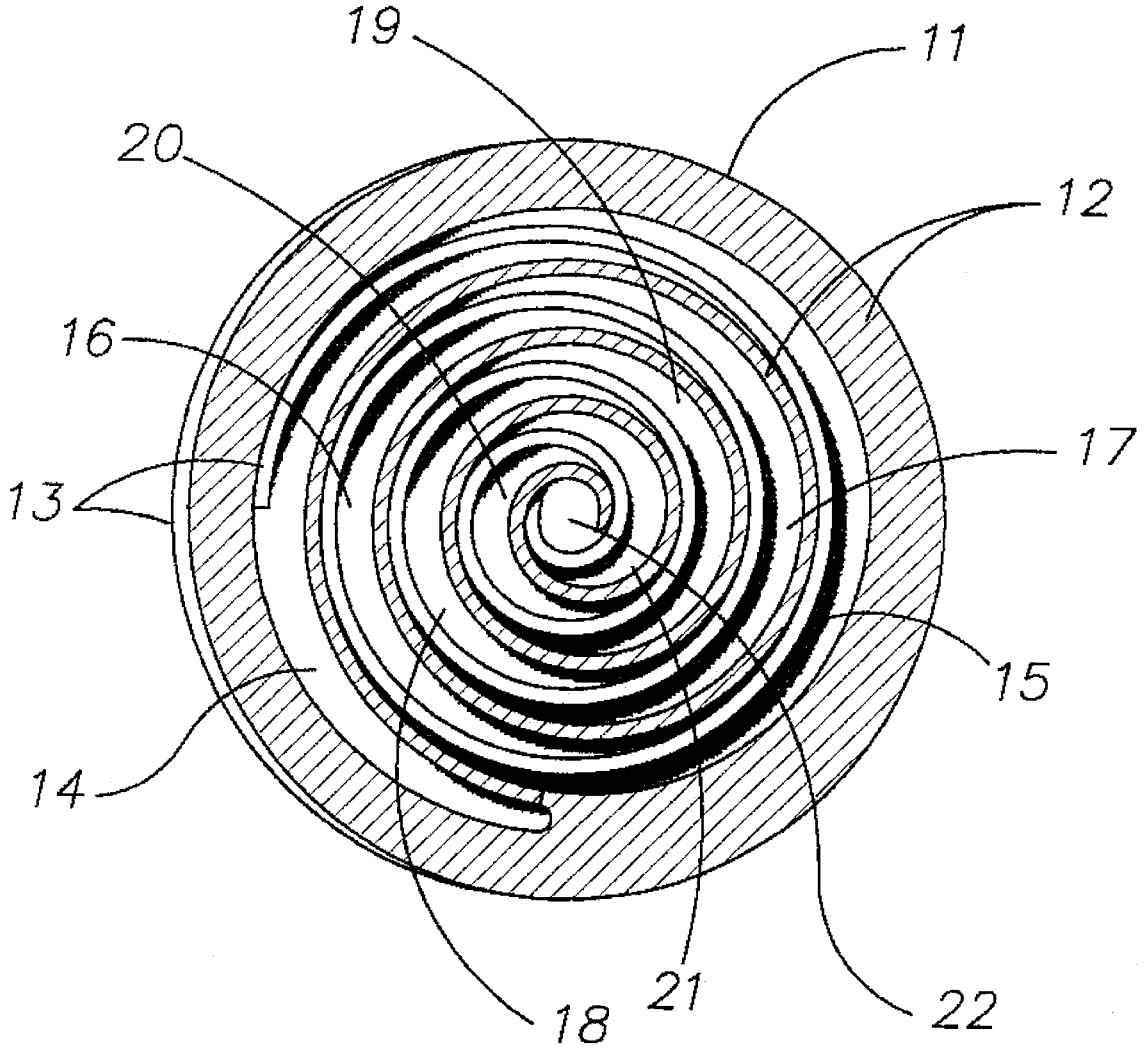
FIG. 2 is a cross-sectional, front elevational view of an oil-free scroll vacuum-pump, showing the features of light-gas isolation and efficient light-gas pumping throughput.

Referring to FIG. 2, the features of a conventional, oil-free scroll vacuum-pump 11 are shown, in order to illustrate the parameters that, when optimized, allows a pump of this type to isolate, or prevent the back migration of, light gases, such as helium and hydrogen, allows for improved pumping efficiency of these gases. The light-gas, isolating, efficient light-gas-pumping-throughput, oil-free, scroll vacuum-pump mechanism 11 consists of close-tolerance, interleaved, oil-free, involute spiral-walls. One, fixed scroll-component 12 has a spiral wall that remains fixed, while an orbiting motion is given to the opposite, orbiting scroll-component, spiral wall 13, in order to trap a volume of gas from the scroll vacuum-pump inlet 14 in the first, vacuum-pump compression-chamber 15, which is a crescent-shaped chamber at the outside diameter of the interleaved spiral walls. As the orbiting motion of the moving scroll, spiral wall progresses, the scroll vacuum-pump's first compression- chamber 15 is compressed along the fixed scroll spiral-wall in a chamber that comes continually smaller, until it is expelled at the pump exhaust-outlet located at the center of the scroll's spiral walls. At each phase of this orbital travel, there are multiple, crescent-shaped compression-chambers between the pump-inlet and the pump exhaust-outlet. In FIG. 2, the first scroll vacuum-pump compression-chamber 15 follows the second, scroll-vacuum pump compression-chamber 16, which, in turn, follows the third, scroll vacuum-pump compression-chamber 17, which follows the fourth, scroll vacuum-pump compression-chamber 18, which, in turn, follows the fifth, scroll vacuum-pump compression-chamber 19, which, in turn, follows the sixth, scroll vacuum-pump compression-chamber 20, which, in turn, follows the seventh, scroll vacuum-pump compression-chamber 21, which is the next, crescent-shaped compression-chamber that will exhaust to the scroll vacuum-pump exhaust 22. It is the discovery of the present invention that the tolerances between the surfaces that form the crescent-shaped chambers, and the number of these chambers between the inlet and the outlet of the pump, play an important part in the ability of the scroll vacuum-pump 11 to isolate light gases and to pump these light gases efficiently. The closer the tolerances between the surfaces forming the crescent-shaped chambers, the greater ability of the scroll-pump to isolate light gases in order to prevent back-diffusion or back-flow, and in order to increase the pumping speed and efficiency thereof. It is envisioned that even closer tolerances than are currently possible would be possible through the use of special manufacturing techniques, such as progressive lapping of the scroll mechanism, by gradually increasing the orbital travel of the mechanism while introducing a lapping compound. The use of resilient, self-lubricating and self-lapping materials in the construction of the fixed scroll-component 12 and/or the orbiting scroll-component 13 would be another method to create ultra-close,compression-chamber mating tolerances that are less than 0.001 inch with an ultimate goal of zero tolerance operation of the compression-chamber surfaces. In zero-tolerance operation, the mating compression-chamber surfaces will require self-lubricating and resilient characteristics, since the melting surfaces would be in actual contact. Such zero-tolerance operation is achieved using engineered plastics and plastic composite materials that are economically molded or formed into the required geometry for the fixed scroll-component 12 and orbiting scroll-component 13, and provide the self-lubricating, resilient, and self-lapping characteristics that would be required to create the ultra-close-tolerance, scroll vacuum-pump mechanism. Self-lapping is defined as the ability of a material to be accurately formed or machined through controlled surface contact; self-lubrication is the ability of a material to provide sufficient lubricity with contacting moving surfaces; and resilience is defined as the ability of a material to withstand slight contact pressure without rapid wear that would quickly create a loss of the ultra-close tolerance clearance with an associated, moving mating surface. It is, also, further envisioned that molds for formed plastic or plastic composite for the scroll vacuum-pump components would make the production of complex fixed scroll-components 12 and orbiting scroll-components 13, that have an increased number of scroll-spiral revolutions, economical. It is, further, envisioned that the application of a self-lubricating, resilient and self-lapping coating would be applied to the internal surfaces of the fixed scroll-component 12 and the orbiting scroll-component 13 to create such ultra-close tolerances.

The number of chambers between the scroll vacuum-pump inlet 14 and the scroll vacuum-pump exhaust 22 is determined by the number of revolutions the scroll's spiral walls make from the outside diameter, or beginning of the compression path, to the inside, or end, of the compression path. We have, further, discovered that the frequency that the crescent shaped compression chambers are formed, compressed and expelled, and the gas pressure in the compression chambers affect the ability of the invention to provide light-gas isolation. The light-gas isolation parameters are a function of the scroll vacuum-pump mechanism's orbiting speed, which is the time required for the orbiting scroll-component 13 to make a complete 360-degree orbital motion, and the gas-pressure in each of the multiple, scroll vacuum-pump compression-chambers, respectively. Both of these parameters relate to the atomic or molecular free-mean path that exists inside the compression chambers as they move from the scroll vacuum-pump inlet 14 to the scroll vacuum-pump exhaust 22. The ability for motion of all atoms and molecules, including the light gases, is based on the mean-free path of an atom or molecule. The mean-free path is the distance that an atom or molecule can travel before colliding with another atom or molecule or the walls that contain them. The higher the gas pressure in a given volume, the higher the concentration of atoms and molecules and subsequently the shorter the free mean path and the higher the probability of an atom or molecule to collide with another. At atmospheric pressure, this distance is approximately 6 millionth of an inch; at a vacuum pressure of one torr, this distance becomes two-thousandths of an inch; at 0.001 torr, this distance has increased to approximately two inches; and a high vacuum-pressure of $1\times10^{-9}$ torr the distance is 30 miles. The unique pumping mechanism of the scroll vacuum pump 11, incorporates the simultaneous rapid compression and rapid movement of multiple close tolerance/short mean free path, gas compression pockets from the scroll vacuum-pump inlet 14 to the scroll vacuum-pump exhaust 22. The unique mechanism of the invention makes it very difficult for even light-active gases to backwards migrate. If a light gas atom is able to backwards migrate from a gas-compression pocket to the neighboring, upstream pocket, it is faced with close tolerance walls and other atoms and molecules that are moving rapidly towards the exhaust, making backwards-migration difficult, if not impossible. The absence of light-gas absorbing materials in the construction of the scroll vacuum-pump 11, such as oil or rubber that can later release the absorbed light gases in bursts that may find their way back to the foreline connection, is the final parameter that insures that light gas isolation and pumping efficiency is optimized.

Figure 3:
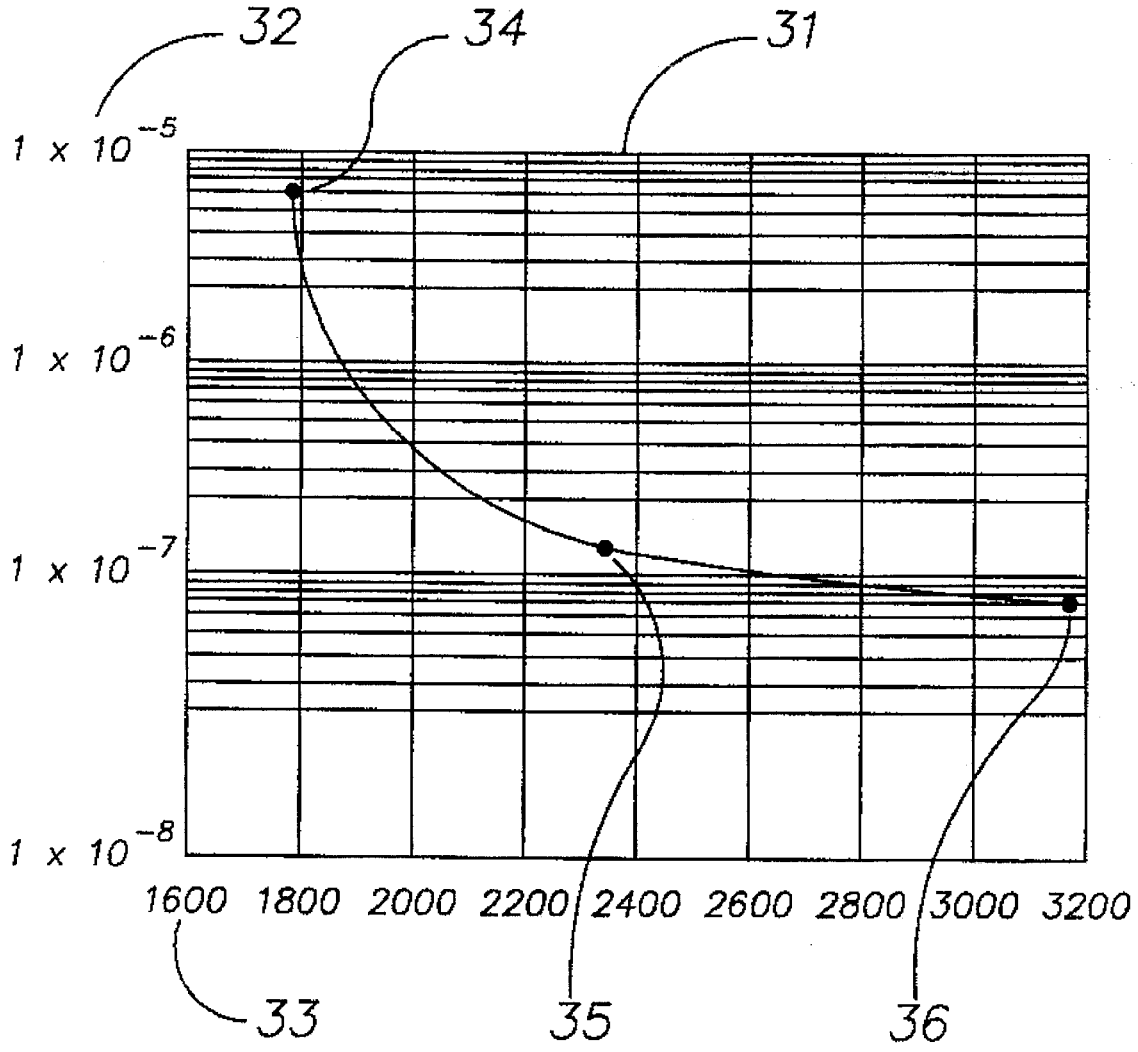
FIG. 3 is a graph showing the effect of orbiting speed on the capability of the oil-free scroll-pump used in the system of the invention in relation to its ability to isolate light gases.

Referring to FIG. 3, a helium-leak chart 31 is shown that verifies the discovery of the present invention. The graph of FIG. 3 shows the relationship of the scroll vacuum-pump's operational speed, defined as orbital cycles per minute, and the ability of the pump to perform effective, light-gas isolation. The helium-leak rate graph 31 consists of a y-scale in atm. cc/sec helium 32, a x-scale in scroll vacuum-pump orbital cycles per minute's 33, a helium-leak rate of $5\times10^{-6}$ atm. cc/sec from the scroll vacuum-pump exhaust to pump-inlet at 1785 orbital cycles per minute's 34, a helium-leak rate of $1.3\times10^{-7}$ atm. cc/sec. helium from the scroll vacuum-pump exhaust to pump-inlet at 2320 orbital cycles per minute 35, and a helium-leak rate of $7\times10^{-8}$ from the scroll vacuum-pump exhaust to pump-inlet at 3180 orbital cycles per minute 36. The graph shows a 7,142% improvement in the helium-leak rate from 1785 orbital cycles per minute to 3180 orbital cycles per minute. The graph of FIG. 3 is based on data that was gathered by connecting an Alcatel helium-leak detector, model ASM-10, that was calibrated using calibrated leak-serial number 1912, dated Nov. 28, 1990, to the inlet port of a Nuvac Innovations model NDP-7 scroll vacuum-pump. The calibration leak-rate value of $1\times10^{-7}$ was adjusted minus 4% to compensate for depletion over time and plus 3% to correct for ambient temperature.

Figure 4:
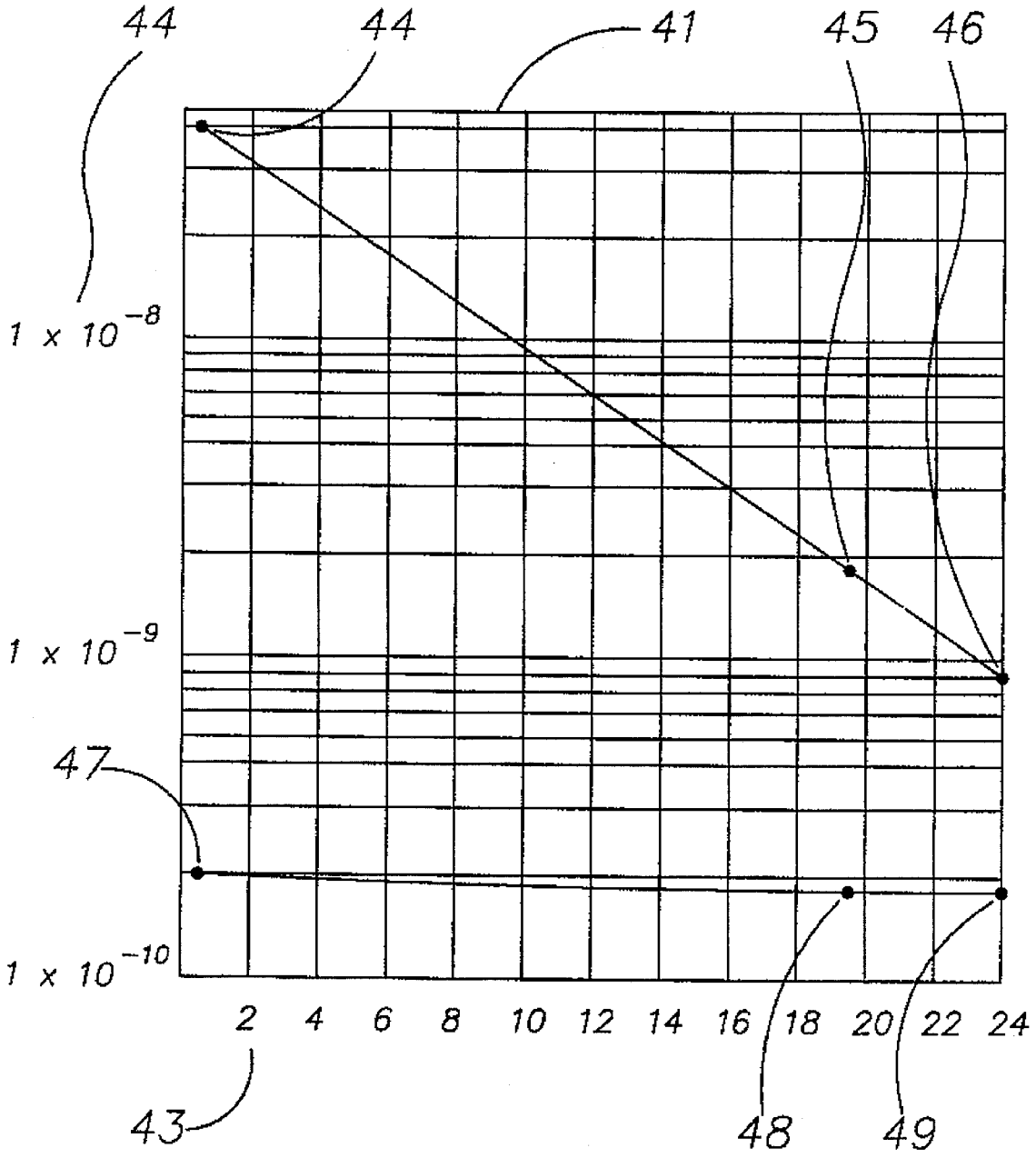
FIG. 4 is a residual-gas analysis graph showing the reduction of background hydrogen in a high-vacuum chamber that is created when using the oil-free, scroll-pump system of the invention in comparison to a conventional, oil-vane, first-stage roughing pump against atmosphere.

Referring to FIG. 4, a residual gas-analysis graph 41 is shown-that comprises a hydrogen partial-vacuum pressure reading values on the y-scale 42 over a x-time-scale 43. The graph-data comprises three hydrogen partial-vacuum pressure-readings taken over a 24-hour period, for a high-vacuum system using a conventional, turbomolecular high-vacuum pump with the foreline backed by a conventional oil-vane rough-vacuum pump, and three, additional, hydrogen partial-pressure readings taken over a 24 hour period for the same, conventional, turbomolecular, high-vacuum pump with the foreline backed instead with the present invention's light-gas-isolating, scroll vacuum-pump operating @ 2320 orbital cycles per minute. The data for this high-vacuum system with oil-vane pump comprises a hydrogen partial-vacuum pressure reading of $4\times10^{-8}$ 44, taken 30 minutes after the turbomolecular pump was started, and 20 minutes after the RGA emission current was started and then de-gassed. Then, a reading of $2\times10^{9}$ 45, was taken 19 hours after the first reading, and finally a reading of $9\times10^{-10}$ 46 was taken 24 hours after the first reading. The data for this high-vacuum system with the present invention's light-gas-isolating scroll vacuum-pump comprises an initial Hydrogen partial-vacuum pressure reading of $2\times10^{-10}$47, taken 30 minutes after the turbomolecular pump was started, and 20 minutes after the RGA emission current was started and then de-gassed, next, a reading of $1.8\times10^{-10}$ 48 was taken 19 hours after the first reading, and finally a reading of $1.8\times10^{-10}$ 49, taken 24 hours after the first reading. This qualitative data represents a 20,000% initial, partial-pressure reading improvement, a 1111% partial-pressure reading improvement after 19 hours, and a 500% partial-pressure reading improvement after 24 hours. This graph, further, shows a gradual reduction in background-hydrogen with the oil-vane pump, due to its inability to efficiently isolate light gases and pump light gases, and an immediate reduction in background-hydrogen with the present invention's scroll vacuum-pump, due to its ability to prevent backwards-migration of light gases and its ability to efficiently pump light gases. The data was gathered by connecting a Spectramass residual-gas analyzer, model number DAQ 3.2, connected to a minimum volume ISO 100 to 2.75 conflat adapter plate, mounted on the ISO 100 inlet of an Alcatel turbomolecular pump model number 5101. The turbomolecular pump was connected to both a Nuvac Innovations model NDP-7 scroll vacuum- pump, and an Alcatel oil-vane pump, model number UM2004A.

Figure 5:
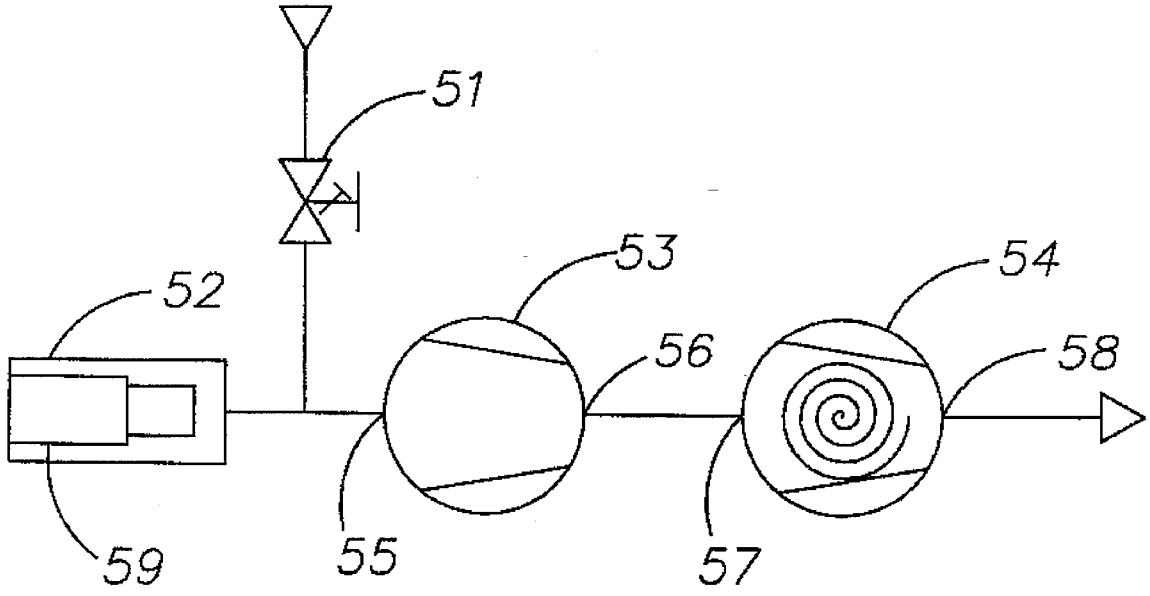
FIG. 5 is a schematic of the improved, high-vacuum pumping configuration of the invention, a mass spectrometer sensor with a high-vacuum inlet valve and a chamber, a second-stage,-high-vacuum pump, and the light-gas-isolating, efficient light-gas-pumping, oil-free, scroll vacuum-pump of the invention used as the first-stage, rough vacuum-pump against atmosphere.

Referring to FIG. 5, the system of the present invention is shown. The light-gas-isolating, scroll vacuum-roughing pump backs a high-vacuum pumping system configuration. The components shown consist of a high-vacuum inlet-valve 51 that is used to introduce a calibrated quantity of gas for the purpose of calibrating a mass spectrometer sensor 59, or for introducing a regulated.-quantity of process gas used to react in a specific manner, with the production parts having been placed inside the high vacuum chamber 52. The components shown further consist of a high-vacuum pump 53 connected to the high-vacuum chamber 52 at the high-vacuum pump inlet 55. The high-vacuum pump 53 evacuates the high-vacuum chamber 52 to a high vacuum pressure that allows the mass spectrometer sensor 59 to function, or to a high-vacuum pressure that is required for the processing of parts that have been placed inside the high-vacuum chamber 52. Typical high-vacuum pumps that are used to perform this chamber-evacuation are: Turbomolecular pumps, molecular drag pumps, combination turbomolecular/molecular drag pumps, and heated oil-diffusion type pumps. These high-vacuum pumps are through-put-type pumps, whose efficiency and effectiveness increase markedly when backed by the present invention's light-gas-isolating, efficient-light-gas-pumping, throughput, scroll vacuum-pump 54, in order to create a continuous, rough vacuum-pressure where the high-vacuum pump-exhaust 56 is connected to the inlet 57 of the scroll vacuum-pump 54. This connection between the high-vacuum pump 53 and the scroll vacuum-pump 54 is called the foreline connection. The purpose of this connection is to further process, remove, or expel the gases that are pumped from the high-vacuum chamber 52 by the high- vacuum pump 53. These gases are expelled through the scroll vacuum-pump exhaust 58. The scroll vacuum-pump 54 also creates a foreline vacuum-pressure that allows the high-vacuum pump 53 to operate at peak efficiency.

Another type of high-vacuum pump that is commonly used in high-vacuum systems is a cryogenic capture-pump. When a cryogenic capture-pump is used as the high-vacuum pump 53, the scroll vacuum-pump 54 does not continuously pump the cryogenic capture-pump or "cryo pump" foreline connection, but, rather, it creates the initial rough-vacuum pressure that is required to start or regenerate the cryogenic pump. In order to start the cryogenic pump, a crossover pressure must first be attained, followed by a rate of vacuum-pressure rise evaluation in order to determine the quality of the previous regeneration. Regeneration of a cryogenic capture-pump requires that the pump be isolated from the process-chamber, and allowed to warm up to temperatures at or above ambient. The regeneration-process then uses the scroll vacuum-pump 54 to evacuate or remove the gases that were captured when the pump was cold. After a successful regeneration, and subsequent evacuation of the cryogenic pump to the crossover pressure, scroll vacuum-pump 54 is isolated from the cryogenic pump by an additional valve, as is conventionally done, and the refrigeration of the cryogenic pump is restarted.

The prior-art, rough-vacuum pumps that have been used to perform roughing functions have long experienced problems that relate to the ability of the rough vacuum-pump to isolate (prevent the back migration) of light gases, and the ability of the pump to efficiently pump light gases. These pumping problems are due to the low atomic mass-weight and small size of light gas-atoms, such as helium or hydrogen, and due to the fact that helium and hydrogen are small, light, fast moving atoms, that do not retain the desired directional velocity for efficient pumping by conventional vacuum-pumps. The inability of conventional high-vacuum pumps to effectively pump light gases is due to excessive back-diffusion, or backwards-migration, of these light gases from the pump-outlet to the pump-inlet. Consequently, if the first-stage rough-vacuum pump cannot effectively pump light gases, some of these light gases which are successfully pumped by the second-stage, high-vacuum pump may back-diffuse into the vacuum-chamber, which the second-stage, high-vacuum pump originally evacuated. This creates a background-sensitivity and stability problem for high-sensitivity helium leak-detectors and residual gas-analysis systems. This, furthermore, creates an unwanted lag in the time required to clear the back-ground light-gas presence after the introduction of light gas. This delay can be very costly in critical vacuum-processes, where light gases are a contaminant, such as in semiconductor, wafer-processing vacuum systems, where equipment-time can cost as much as $100,000 per hour. This delay can be costly, time consuming, and frustrating in applications where the short-cycle introduction of gases is a possibility, such as in the detection of helium leaks in complex vacuum-systems where it is difficult to pinpoint the actual location of multiple leaks. In some cases, this delay can actually defeat the leak-detection process itself. In many, critical, high-vacuum pumping systems that use cryogenic capture-pumps, the capture-capacity for light gases is the factor that determines the pump up time or time between regenerations. Light gases are the only gases that are not condensed in a cryogenic pump but rather absorbed into an activated charcoal-array. The capture-capacity for these light gases is typically 100 times less than the capacity for other condensable gases. This limited capture-capacity is further reduced if the rough vacuum-pump used to regenerate the cryogenic pump does not effectively remove the light gases from the charcoal-array. Cryogenic pumps are the high-vacuum pump of choice in many critical and expensive vacuum processes. Such vacuum-system problems are overcome by the unique pumping mechanism characteristics of the present invention's efficient light-gas-pumping throughput, scroll vacuum-pump.

While a specific embodiment of the invention has been shown and described, it is to be understood that numerous changes and-modifications may be made therein without departing from the scope, spirit and intent of the invention as set forth in the appended claims.

What is claimed is:

1. A method of isolating ambient, light gases from entering into a vacuum system that is being evacuated to a high vacuum by means of a high-vacuum pumping means, by using an oil-free, scroll vacuum-pump comprising a first, scroll-component having a first involute, spiral-wall section, and a second scroll-component having a second involute, spiral-wall section; at least one of said first and second scroll-components being mounted for relative orbital movement with respect to the other, and said first and second involute, spiral-wall sections being interleaved to a predetermined tolerance of contacting, mating surface-portions thereof, and continuously forming pockets between said contacting, mating surface-portions as said components experience relative orbital motion, said method comprising:

(a) coupling the oil-free, scroll vacuum-pump to the vacuum system as a roughing pump, so that the outlet of the oil-free, scroll vacuum-pump is at ambient;

(b) preventing the back-flow of light gases from ambient to the inlet of the oil-free, scroll vacuum-pump;

(c) said step (b) comprising operatively forming during operation of the oil-free, scroll vacuum-pump as great a number of pockets in the oil-free, scroll vacuum-pump, whereby, the greater the number of pockets formed for each orbital cycle of the oil-free, scroll vacuum-pump, the more effective the oil free, scroll vacuum-pump is in preventing back-flow of light gases from its outlet to its inlet;

said step (c) comprising operating said oil-free, scroll vacuum-pump faster than approximately 1800 orbital cycles per minute.

2. The method according to claim 1, wherein said step (c) comprises forming at least seven said pockets for each said orbital cycle.

3. The method according to claim 1, wherein said step (b) comprises providing close to zero tolerance between said contacting, mating surcace-portions of said first involute, spiral-wall section, and said second involute, spiral-wall section.

* * * * *